US009349560B2

(12) United States Patent
Rane et al.

(10) Patent No.: US 9,349,560 B2
(45) Date of Patent: May 24, 2016

(54) LIMITER TYPE AIR CIRCUIT BREAKER WITH BLOW OPEN ARRANGEMENT

(71) Applicant: General Electric Company, Schenectady, NY (US)

(72) Inventors: Mahesh Jaywant Rane, Andhra Pradesh (IN); Saugata Das, Andhra Pradesh (IN); Glen Charles Sisson, Wolcott, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 171 days.

(21) Appl. No.: 14/185,036

(22) Filed: Feb. 20, 2014

(65) Prior Publication Data

US 2015/0235795 A1 Aug. 20, 2015

(51) Int. Cl.

| | |
|---|---|
| ***H01H 73/02*** | (2006.01) |
| ***H01H 71/10*** | (2006.01) |
| ***H01H 71/50*** | (2006.01) |

(52) U.S. Cl.

CPC ..... *H01H 73/02* (2013.01); *H01H 71/1054* (2013.01); *H01H 71/50* (2013.01); *H01H 71/504* (2013.01); *H01H 71/505* (2013.01)

(58) Field of Classification Search

CPC ..... H01H 1/225; H01H 1/226; H01H 77/102; H01H 77/104; H01H 2009/305

See application file for complete search history.

(56) References Cited

U.S. PATENT DOCUMENTS

| | | | | |
|---|---|---|---|---|
| 2,568,008 A | | 9/1951 | Jansson | |
| 3,174,022 A | | 3/1965 | Peek | |
| 4,219,713 A | * | 8/1980 | Maier et al. | 200/400 |
| 4,276,526 A | | 6/1981 | Ciarcia et al. | |
| 4,611,187 A | * | 9/1986 | Banfi | 335/16 |
| 4,695,690 A | * | 9/1987 | Banfi | 218/32 |
| 5,912,605 A | | 6/1999 | Eberts | |
| 5,926,081 A | | 7/1999 | DiMarco et al. | |
| 6,005,206 A | | 12/1999 | Rakus et al. | |
| 6,018,284 A | | 1/2000 | Rival et al. | |
| 6,204,465 B1 | * | 3/2001 | Gula et al. | 218/154 |
| 6,218,919 B1 | | 4/2001 | Ciarcia et al. | |

(Continued)

FOREIGN PATENT DOCUMENTS

GB 535461 A 4/1941

OTHER PUBLICATIONS

Dovjikov et al., "Performance Test of the Allgemeine Elktricitats Gesellschaft Free-Jet Air-Blast 220-Kv 2,500-Megavolt-Ampere Reclosing Circuit Breaker" AIEE Transactions, 1948, vol. 67, pp. 295-306.

*Primary Examiner* — Mohamad Musleh

(74) *Attorney, Agent, or Firm* — GE Global Patent Operation; Stephen G. Midgley

(57) ABSTRACT

A circuit breaker and a method of developing the current limiting circuit breaker are described. The circuit breaker includes a carrier assembly to supply current to a circuit through a fixed contact in a first operative state. The carrier assembly includes a latch pin to move responsive to a force transferred to the latch pin as a result of a fault condition in the circuit, a cam assembly in contact with the latch pin to move responsive to movement of the latch pin, and a movable contact coupled to the cam assembly, the movable contact breaking the physical contact with the fixed contact to put the circuit breaker in a second operative state. The circuit breaker also includes a mechanism to move the carrier assembly responsive to a signal indicative of the fault condition to put the circuit breaker in a third operative state.

11 Claims, 6 Drawing Sheets

(56) References Cited

U.S. PATENT DOCUMENTS

| | | | | |
|---|---|---|---|---|
| 6,376,788 | B1 | 4/2002 | Jones et al. | |
| 6,437,269 | B1 | 8/2002 | Rakus | |
| 6,437,960 | B1 | 8/2002 | Chen et al. | |
| 6,977,568 | B1 | 12/2005 | Rakus et al. | |
| 7,705,263 | B2 | 4/2010 | Rane et al. | |
| 7,935,902 | B2 | 5/2011 | Newase et al. | |
| 2009/0050460 | A1* | 2/2009 | Ahn | 200/400 |
| 2009/0091407 | A1 | 4/2009 | Sudhakar et al. | |
| 2009/0128265 | A1 | 5/2009 | Sudhakar et al. | |
| 2010/0258415 | A1 | 10/2010 | Kapples et al. | |

* cited by examiner

LIMITER TYPE AIR CIRCUIT BREAKER WITH BLOW OPEN ARRANGEMENT

BACKGROUND OF THE INVENTION

The subject matter disclosed herein relates to a current-limiting circuit breaker.

A circuit breaker is an automatically operated electrical switch that interrupts current flow when a fault is detected. This prevents an overload or short circuit that can damage the circuit being protected by the circuit breaker. Interruption of the current generates an arc which must be extinguished to prevent damage caused by the arc flash. In an air circuit breaker, the arc is broken by air (e.g., displaced air resulting from the contacts being moved into a closed chamber). The speed with which the arc is broken can affect the extent of damage. That is, a current limiting circuit breaker reduces the fault energy that flows into the circuit and, therefore, reduces any damage to the circuit caused by the fault.

BRIEF DESCRIPTION OF THE INVENTION

According to one aspect of the invention, a circuit breaker includes a carrier assembly configured to supply current to a circuit through a fixed contact in a first operative state, the carrier assembly comprising a latch pin configured to move responsive to a force transferred to the latch pin as a result of a fault condition in the circuit; a cam assembly in contact with the latch pin and configured to move responsive to movement of the latch pin; and a movable contact coupled to the cam assembly and in physical contact with the fixed contact of the circuit to supply the current to the circuit in the first operative state, the movable contact configured to break the physical contact with the fixed contact of the circuit responsive to movement of the cam assembly to put the circuit breaker in a second operative state; and a mechanism configured to move the carrier assembly responsive to a signal indicative of the fault condition to put the circuit breaker in a third operative state, wherein the movable contact of the carrier assembly is configured to break the physical contact with the fixed contact of the circuit to put the circuit breaker in the second operative state responsive to movement of the latch pin and the cam assembly prior to the mechanism moving the carrier assembly to put the circuit breaker in the third operative state responsive to the signal.

According to another aspect of the invention, a current limiting assembly includes a latch pin configured to move responsive to a force transferred to the latch pin as a result of a fault condition in a circuit coupled to the assembly; a cam assembly in contact with the latch pin and configured to move responsive to movement of the latch pin; and a movable contact coupled to the cam assembly and in physical contact with a fixed contact of the circuit to supply current to the circuit in a first operative state, the movable contact configured to break the physical contact with the fixed contact of the circuit responsive to movement of the cam assembly to establish a second operative state.

According to yet another aspect of the invention, a method of developing a current limiting circuit breaker includes arranging a carrier assembly in physical contact with a circuit, the carrier assembly supplying current to the circuit through a fixed contact in a first operative state, the arranging the carrier assembly further comprising arranging a latch pin of the carrier assembly to move responsive to a force transferred to the latch pin as a result of a fault condition in the circuit; arranging a cam assembly of the carrier assembly to be in contact with the latch pin, the cam assembly moving responsive to movement of the latch pin; and arranging a movable contact of the carrier assembly to be coupled to the cam assembly and in physical contact with the fixed contact of the circuit in the first operative state, the movable contact breaking the physical contact with the fixed contact of the circuit responsive to movement of the cam assembly to put the circuit breaker in a second operative state; and arranging a mechanism coupled to the carrier assembly, the mechanism moving the carrier assembly responsive to a signal indicative of the fault condition to put the circuit breaker in a third operative state, wherein the movable contact breaking the physical contact with the fixed contact to put the circuit breaker in the second operative state is prior to the mechanism moving the carrier assembly to put the circuit breaker in the third operative state.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

As noted above, speed of operation of a circuit breaker is a key factor in limiting fault energy. Typically, a circuit breaker includes a trip mechanism that receives a fault signal and initiates operation of a carrier assembly that resides between the trip mechanism and the circuit to be protected. The operation of the carrier assembly by the trip mechanism creates the open condition in which current flow to the circuit is interrupted. Embodiments of the system and method described herein relate to a carrier assembly that additionally operates based on an electro dynamic force generated by the fault current. Specifically, the latch pin initiates the break in contact based on the force.

Figure 1:
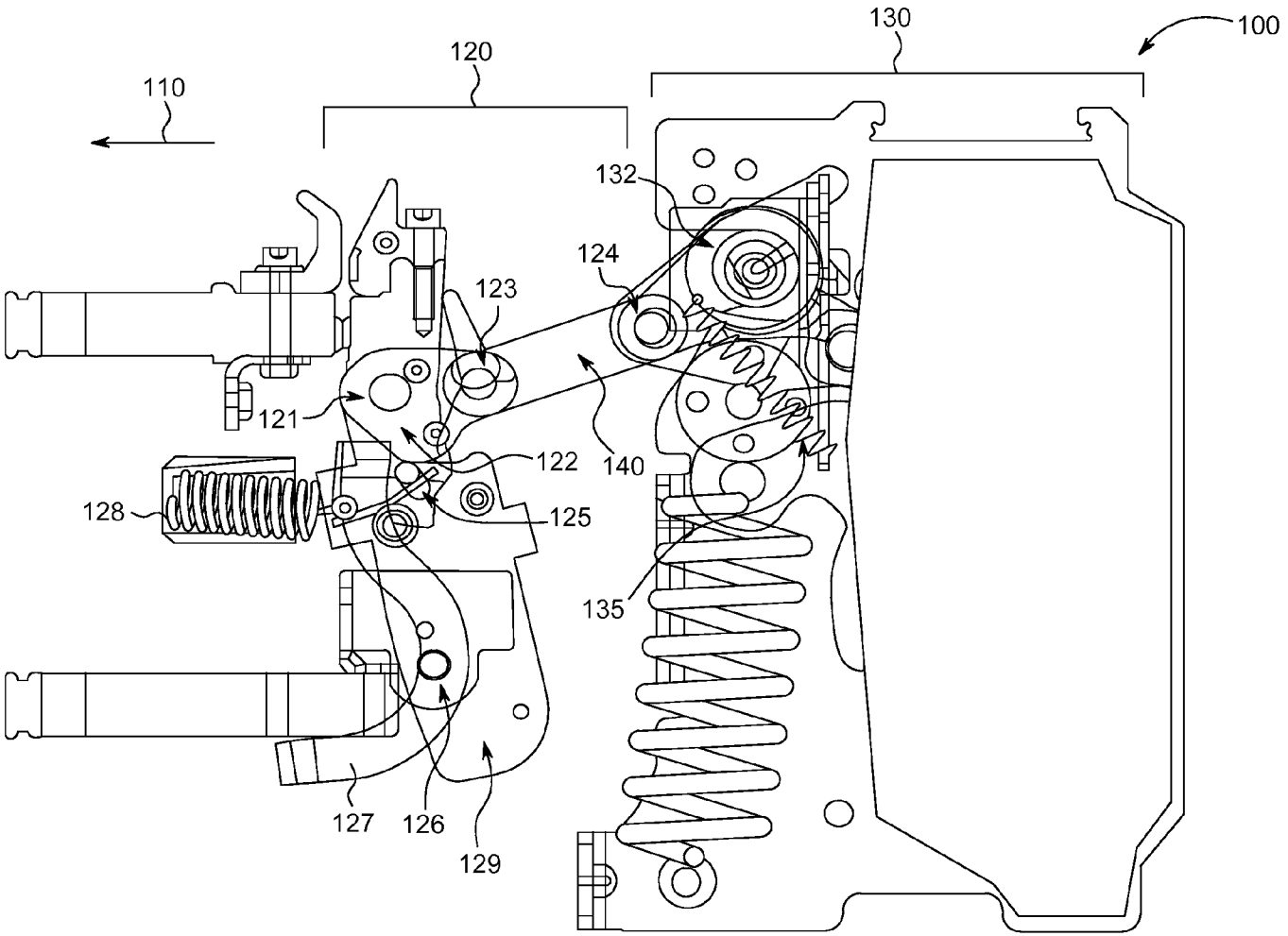
FIG. 1 details a circuit breaker according to an embodiment of the invention.
Figure 2:
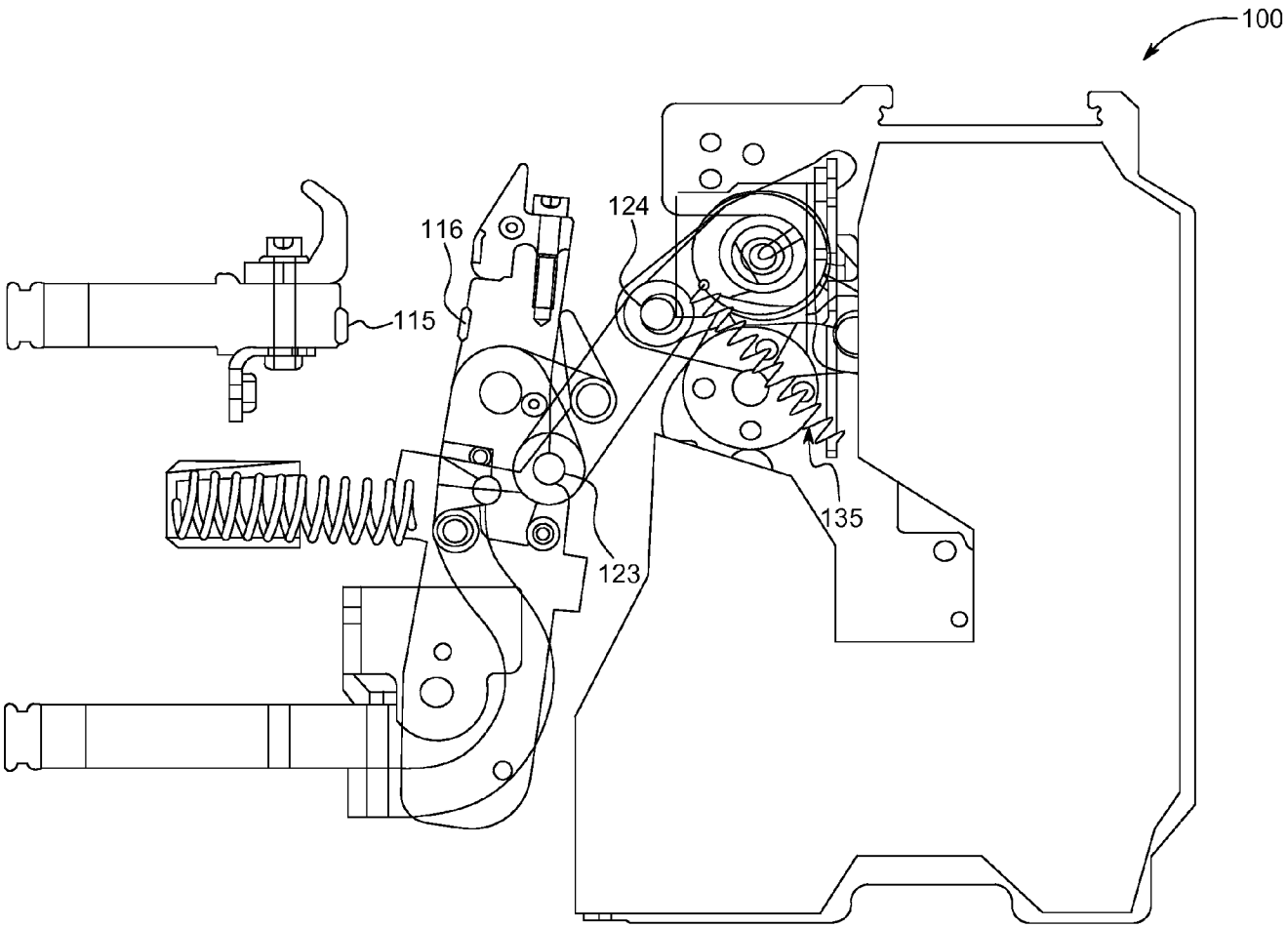
FIG. 2 depicts the circuit breaker according to the embodiment shown in FIG. 1.

FIG. 1 details a circuit breaker 100 according to an embodiment of the invention. The view shown by FIG. 1 is a perspective side view showing one set of contacts. As shown in FIG. 1, the circuit breaker 100 is in the closed ("on") position with current flowing to the circuit 110. Based on a fault, the carrier assembly 120 between the circuit 110 and the mechanism 130 physically disengages from the circuit 110, thereby disengaging the fixed contact 115 (FIG. 2) of the circuit from the moving contact 116 (FIG. 2) of the carrier assembly 120. The mechanism 130 receives a signal based on a fault condition being detected and pulls the carrier assembly 120 away from the circuit 110 to fully disengage contact between the circuit 110 and the carrier assembly 120. The mechanism 130 and the carrier assembly 120 are connected via a pole coupler 140 (ending at a lay shaft 132 at the mechanism 130). The pole coupler 140 attaches to the mechanism 130 at the lay shaft pivot 124 and to the carrier assembly 120 at the pole coupler pin 123. The mechanism 130 facilitates resetting the circuit breaker 100 (back to the position shown in FIG. 1) following a fault detection and clearing procedure. In a conventional selective circuit breaker, the mechanism 130 is the only initiator of a break in contact. According to the embodiment shown in FIG. 1, the carrier assembly 120 disengages from the circuit 110 in less time than it takes for the mechanism 130 alone to break the contact, as detailed below. That is, the carrier assembly 120 breaks the contact to limit the flow of fault current and, subsequently, the mechanism 130 fully disengages the carrier assembly 120 in preparation for reset. The carrier assembly 120 includes a contact arm and cam pivot pin 121. As illustrated by the discussion of FIG. 2 below, the inclusion of the cam assembly 122 and the contact arm and cam pivot pin 121 facilitates the current limiting feature of the circuit breaker 100. More particularly, the arrangement of the cam assembly 122 and the latch pin 125 allow the carrier assembly 120 to be pushed away from the circuit 110. FIG. 1 also shows the bottom portion of the contact arm 127 extending from the moving contact 116, the carrier assembly pivot 126, the carrier assembly spring 128, and the latching bracket assembly 129. The lay shaft resetting spring 135 facilitates resetting of the cam assembly 120 and lay shaft 132 as discussed with reference to FIG. 3 below.

FIG. 2 depicts the circuit breaker 100 according to the embodiment shown in FIG. 1. In FIG. 2, contact between the circuit 110 and the carrier assembly 120 is broken (as indicated by "A"). This break (A) is caused by the force exerted in the direction B by the fault current. The force may be an electro dynamic force. The moving contact 116 of the carrier assembly 120 is pushed away from the fixed contact 115 by the fault current force (B) in the following way. The force from the fault current is transferred to the pole coupler pin 123 through the contact arm and cam pivot pin 121 and cam assembly 122. Because the lay shaft pivot 124 is rigid, a component of the force on the pole coupler pin 123 is transferred to the spring loaded latch pin 125 through the cam assembly 122. As the fault current increases, this force also increases and pushes the latch pin 125 along a slot 610 (detailed in FIG. 6). Movement of the latch pin 125 causes the cam assembly 122 to start rotating with the contact arm and cam pivot pin 121. This causes the moving contact 116 of the carrier assembly 120 to start moving until the contact gap (A) is achieved. A comparison of FIG. 1 (showing the circuit breaker 100 in the closed position) with FIG. 2 (showing the circuit breaker 100 in a blow open position).

Figure 3:
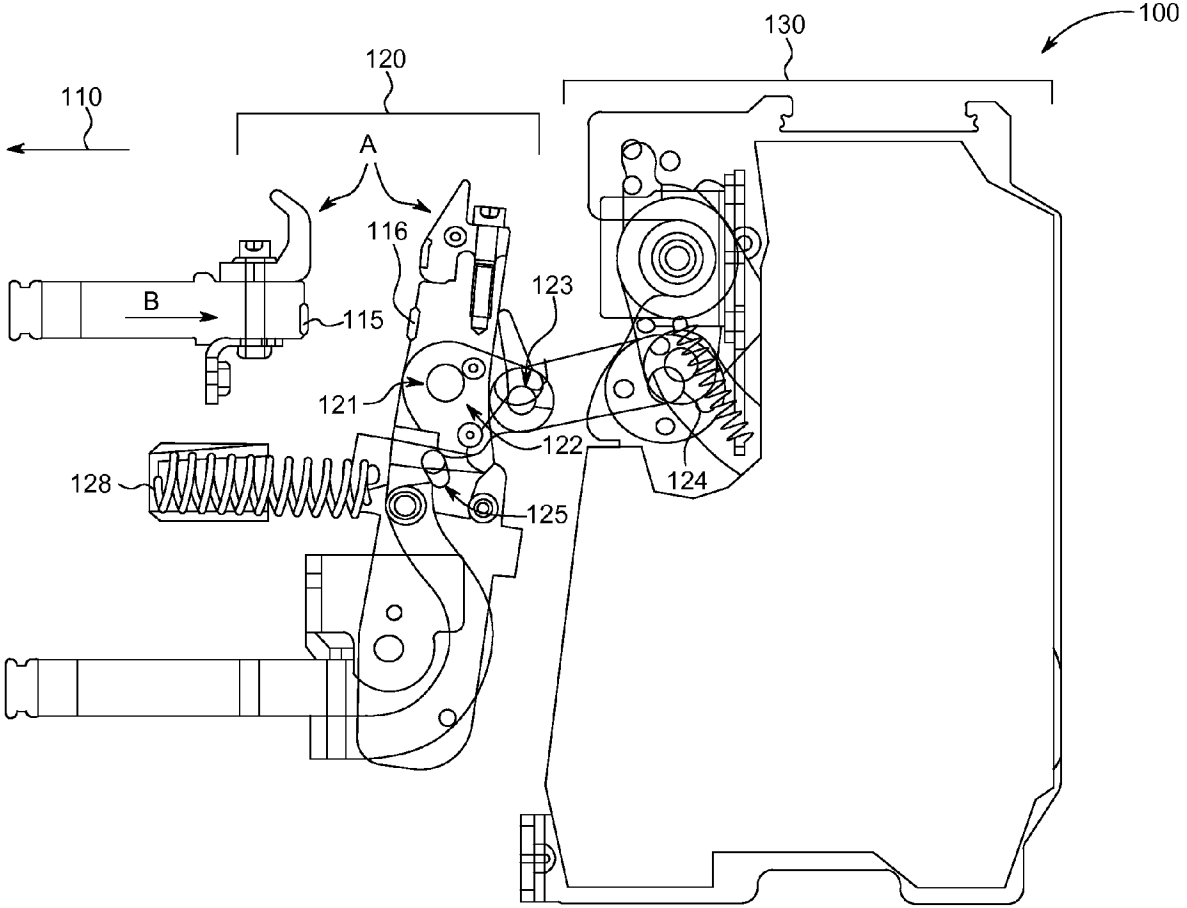
FIG. 3 depicts the circuit breaker according to the embodiment shown in FIG. 1.

FIG. 3 depicts the circuit breaker 100 according to the embodiment shown in FIG. 1. In FIG. 3, the carrier assembly 120 is in the off position. That is, in addition to the carrier assembly 120 being pushed away from contact with the circuit 110 based on force exerted by the fault current, the carrier assembly 120 is placed in the full disengagement position (readied for reset) by the mechanism 130. As a comparison of FIG. 2 (showing the circuit breaker 100 in the blow open position) with FIG. 3 (showing the circuit breaker 100 in the off position) indicates, the lay shaft resetting spring 135 aids in the lay shaft pivot 124 moving down, thereby relaxing the mechanism spring 135 and the mechanism 130 being positioned for reset of the circuit breaker 100. To be clear, the fixed contact 115 and moving contact 116 disengage, thereby limiting fault current, prior to action by the mechanism 130. The disengagement is based on the configuration of the carrier assembly 120 as discussed with reference to FIG. 2 above. However, in order for the mechanism 130 to be able to reset the circuit breaker 100, the mechanism 130 must put the carrier assembly 120 in a fully disengaged position (referred to as the off position here). From the position shown in FIG. 3, rotation at the pole coupler pin 123 based on force from the mechanism 130 puts the circuit breaker 100 back in the closed position shown in FIG. 1.

Figure 4:
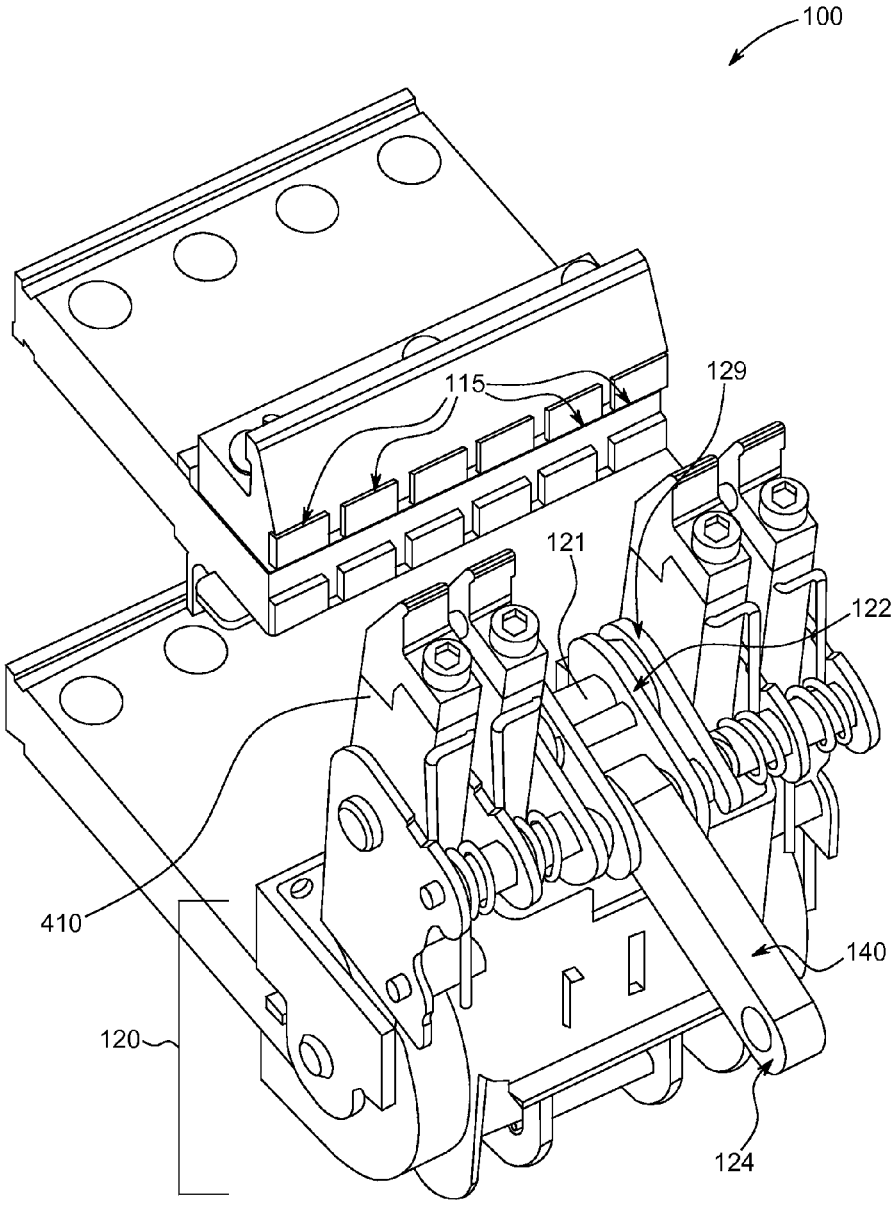
FIG. 4 is a three-dimensional view of the circuit breaker according to an embodiment of the invention.

FIG. 4 is a three-dimensional view of the circuit breaker 100 according to an embodiment of the invention. As FIG. 4 makes clear, multiple sets of contacts (fixed contact 115 and moving contact 116) may be affected with the carrier assembly 120. The moving contact arms 127 that correspond with the moving contacts 116 are shown in FIG. 4. While the exemplary circuit breaker 100 shown in FIG. 4 includes four fixed contacts 115, the circuit breaker 100 according to embodiments of the invention is not limited to any particular number and may have one, eight, or another number of fixed contacts 115, for example.

Figure 5:
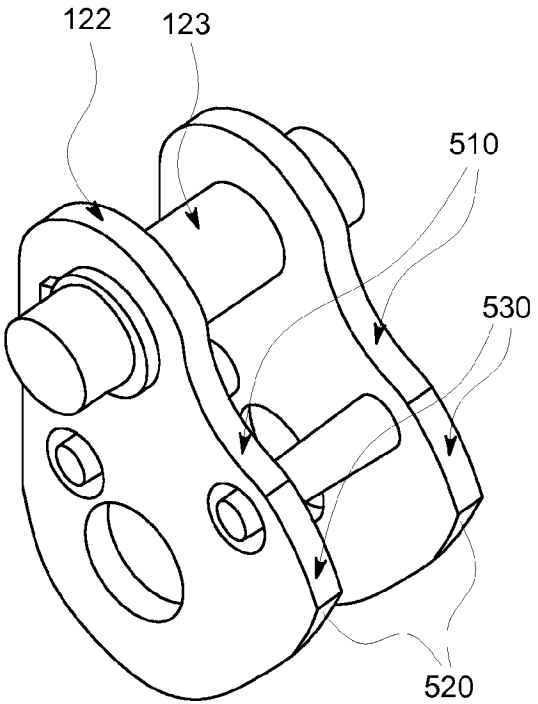
FIG. 5 details the cam assembly according to an embodiment of the invention.

FIG. 5 details the cam assembly 122 according to an embodiment of the invention. The dent 510 in the cam assembly 122 prevents unwanted re-closure of the contacts (fixed contacts 115 and corresponding moving contacts 116). Because the fault force that creates the gap (A) between the fixed and moving contacts 115, 116 may generate enough inertia in carrier assembly 120 at a rate of speed that is sufficient to cause bounce back of the carrier assembly 120, the dent 510 is designed to prevent any re-closure of the circuit breaker 100 based on its shape. The latch surface 520 indicates the portion of the cam assembly 122 that contacts the latch pin 125 when the circuit breaker 100 is in the closed position. The cam assembly 122 moves the latch pin 125 to disengage the fixed contacts 115 from the corresponding moving contacts 116. The de-latch surface 530 is the surface that contacts the latch pin 125 during the blow open operation and during reset operation.

Figure 6:
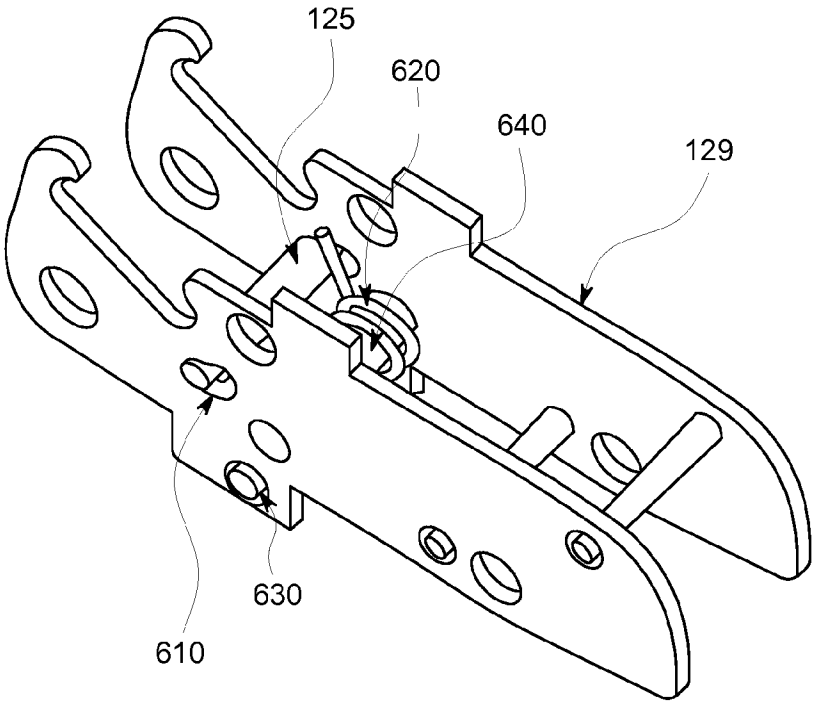
FIG. 6 details the latching bracket assembly according to an embodiment of the invention.

FIG. 6 details the latching bracket assembly 129 according to an embodiment of the invention. The latch pin 125 need not necessarily have a cylindrical surface and need not necessarily slide along a slot 610. In alternate embodiments, the latch pin 125 may be pivoted in circular holes instead of slots 610 and may rotate instead of sliding due to the force resulting from the fault condition. The latch pin 125 is spring-loaded. The latching spring 620 is wound around a latching spring mount 640 having a latching spring arm support 630. The exemplary latch pin 125 is shown as being spring-mounted based on a latching spring 620. In alternate embodiments, the latch pin 125 may be operated based on a different type of spring such as a tension spring, for example. The interface surfaces of the cam assembly 122, the latch pin 125, and the slot 610 may be provided with a heat treatment or surface finish or with bearing parts that minimize friction and facilitate smooth operation of the carrier assembly 120.

Figure 7:
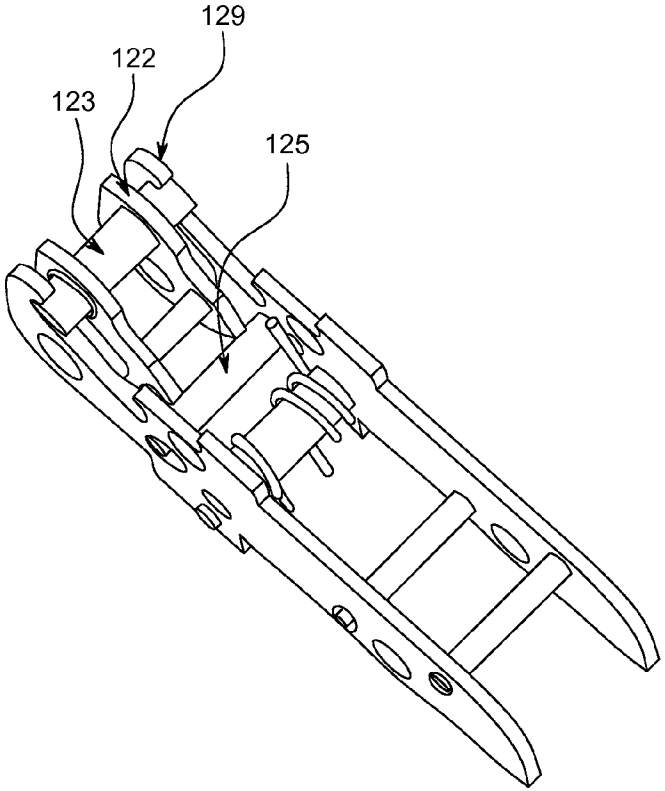
FIG. 7 details the arrangement between the latching bracket assembly and cam assembly according to an embodiment of the invention.

FIG. 7 details the arrangement between the latching bracket assembly 129 and cam assembly 122 according to an embodiment of the invention. As FIG. 7 shows, the pole coupler pin 123 is held by the latching bracket assembly 129 and goes through the cam assembly 122 such that the cam assembly 122 may rotate about the pole coupler pin 123 to move the latching pin 125.

Figure 8:
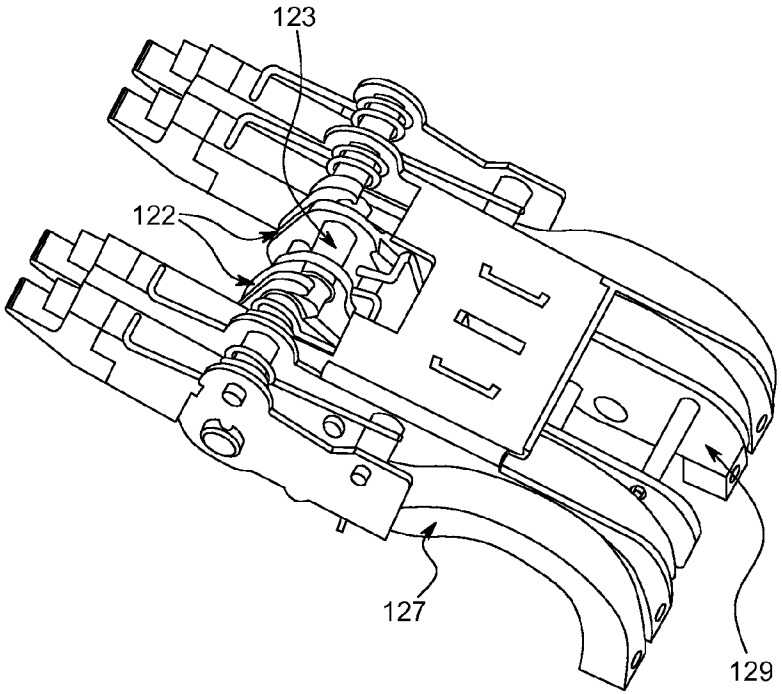
FIG. 8 details the arrangement between the contact arms, the latching bracket assembly, and the cam assembly according to an embodiment of the invention.

FIG. 8 details the arrangement between the contact arms 127, the latching bracket assembly 129, and the cam assembly 122 according to an embodiment of the invention. FIG. 8 shows the arrangement of the latching bracket assembly 129 and cam assembly 122 shown in FIG. 7 between the contact arms 127. However, while the latching bracket assembly 129 is shown between the contact arms 127, in alternate embodiments, the latching bracket assembly 129 (cam assembly 122 and pole coupler pin 123) may be on both sides of the circuit breaker 100 while the contact arms 127 are in the middle.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A circuit breaker, comprising:

a carrier assembly configured to supply current to a circuit through a fixed contact in a first operative state, the carrier assembly comprising, a latch pin configured to move responsive to a force transferred to the latch pin as a result of a fault condition in the circuit;

a cam assembly in contact with the latch pin and configured to move responsive to movement of the latch pin; and a movable contact coupled to the cam assembly and in physical contact with the fixed contact of the circuit to supply the current to the circuit in the first operative state, the movable contact configured to break the physical contact with the fixed contact of the circuit responsive to movement of the cam assembly to put the circuit breaker in a second operative state; and a mechanism configured to move the carrier assembly responsive to a signal indicative of the fault condition to put the circuit breaker in a third operative state, wherein the movable contact of the carrier assembly is configured to break the physical contact with the fixed contact of the circuit to put the circuit breaker in the second operative state responsive to movement of the latch pin and the cam assembly prior to the mechanism moving the carrier assembly to put the circuit breaker in the third operative state responsive to the signal.

2. The circuit breaker according to claim 1, further comprising a pole coupler connecting the carrier assembly to the mechanism.

3. The circuit breaker according to claim 2, wherein the mechanism comprises a spring configured to move the pole coupler to put the circuit breaker in the third operative state from the second operative state.

4. The circuit breaker according to claim 1, wherein the carrier assembly further comprises a latching bracket assembly and the latch pin is configured to move along a slot in the latching bracket assembly based on the force.

5. The circuit breaker according to claim 4, wherein the latching bracket assembly and the cam assembly are connected through a pivot pin.

6. The circuit breaker according to claim 5, wherein the force is initially transferred to the pivot pin prior to cause movement of the latch pin.

7. The circuit breaker according to claim 1, wherein the cam assembly is arranged in a center of a plurality of the movable contacts of the carrier assembly that correspond with a plurality of the fixed contacts of the circuit.

8. The circuit breaker according to claim 1, wherein the latch pin is spring-loaded.

9. The circuit breaker according to claim 1, wherein the cam assembly includes a dented portion configured to prevent bounce-back of the carrier assembly reestablishing contact with the circuit.

10. A method of developing a current limiting circuit breaker, the method comprising:

arranging a carrier assembly in physical contact with a circuit, the carrier assembly supplying current to the circuit through a fixed contact in a first operative state, the arranging the carrier assembly further comprising, arranging a latch pin of the carrier assembly to move responsive to a force transferred to the latch pin as a result of a fault condition in the circuit;

arranging a cam assembly of the carrier assembly to be in contact with the latch pin, the cam assembly moving responsive to movement of the latch pin; and arranging a movable contact of the carrier assembly to be coupled to the cam assembly and in physical contact with the fixed contact of the circuit in the first operative state, the movable contact breaking the physical contact with the fixed contact of the circuit responsive to movement of the cam assembly to put the circuit breaker in a second operative state; and arranging a mechanism coupled to the carrier assembly, the mechanism moving the carrier assembly responsive to a signal indicative of the fault condition to put the circuit breaker in a third operative state, wherein the movable contact breaking the physical contact with the fixed contact to put the circuit breaker in the second operative state is prior to the mechanism moving the carrier assembly to put the circuit breaker in the third operative state.

11. The method according to claim 10, further comprising arranging the cam assembly in a center of a plurality of movable contacts of the carrier assembly, each of the plurality of movable contacts corresponding, with one of a plurality of the fixed contacts of the circuit.

* * * * *